United States Patent [19]

Bailey

[11] Patent Number: 4,619,428

[45] Date of Patent: Oct. 28, 1986

[54] SUPPORT MEMBER FOR APERTURED SUPPORTING SURFACES

[76] Inventor: James R. Bailey, 4020 N. Pioneer, Chicago, Ill. 60634

[21] Appl. No.: 689,146

[22] Filed: Jan. 7, 1985

Related U.S. Application Data

[63] Continuation of Ser. No. 516,637, Jul. 25, 1983, abandoned.

[51] Int. Cl.[4] ..... B61L 5/00

[52] U.S. Cl. ..... 248/221.2; 248/221.3; 248/222.1

[58] Field of Search ..... 248/221.1, 221.2, 221.3, 248/220.4, 221.4, 220.3, 239

[56] References Cited

U.S. PATENT DOCUMENTS

| | | | |
|---|---|---|---|
| 1,840,138 | 1/1932 | Swallow | 248/221.3 |
| 2,144,602 | 1/1939 | Balmer | 248/222.1 |
| 3,227,412 | 1/1966 | Terlinde | 248/221.2 |
| 3,601,432 | 8/1971 | Fenwick | 248/222.1 |
| 4,228,906 | 10/1980 | Jones | 248/222.1 |
| 4,303,217 | 12/1981 | Garfinkle | 248/221.1 |
| 4,387,872 | 6/1983 | Hogue | 248/221.3 |
| 4,441,619 | 4/1984 | Gibitz | 248/222.1 |
| 4,506,856 | 3/1985 | Rich | 248/221.2 |

FOREIGN PATENT DOCUMENTS

| | | | |
|---|---|---|---|
| 1188778 | 3/1965 | Fed. Rep. of Germany | 248/222.1 |
| 1503226 | 12/1966 | Fed. Rep. of Germany | 248/225.2 |
| 948828 | 2/1964 | United Kingdom | 248/222.1 |
| 1361087 | 7/1974 | United Kingdom | 248/222.1 |

*Primary Examiner*—Reinaldo P. Machado
*Assistant Examiner*—Alvin Chin-Shue
*Attorney, Agent, or Firm*—Charles F. Lind

[57] ABSTRACT

A support member for apertured supporting surfaces having at least three aligned equally spaced holes or apertures penetrating through said supporting surfaces is provided with means for locking said support member with respect to said supporting surfaces so that the support member will not become disengaged from the supporting surface in ordinary usage.

3 Claims, 29 Drawing Figures

FIG. 20
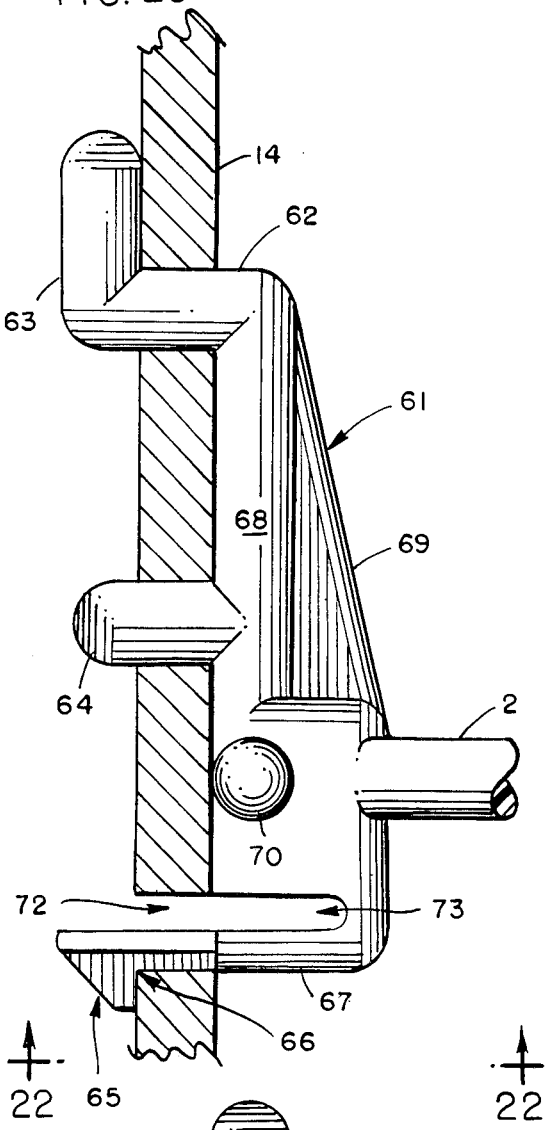
FIG. 21
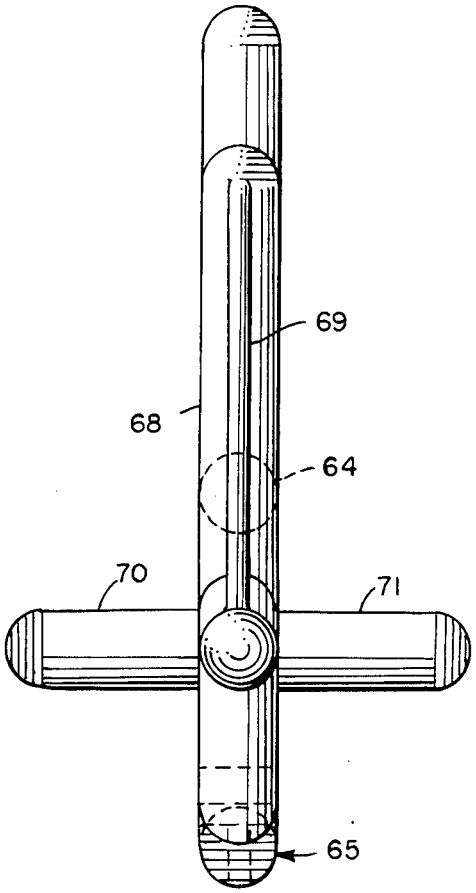
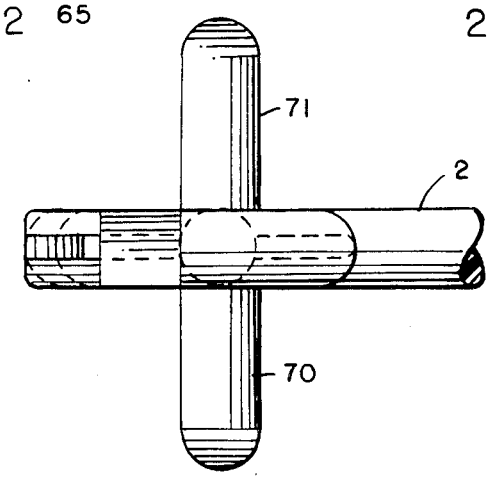
FIG. 22

SUPPORT MEMBER FOR APERTURED SUPPORTING SURFACES

This is a continuation application of my copending application Ser. No. 06/516,637 filed July 25, 1983, now abandoned and entitled SUPPORT MEMBER FOR APERTURED SUPPORTING SURFACES.

BACKGROUND

It is well known in the art to provide support members which can be inserted into apertures in Peg-Board of the type manufactured by The Masonite Corporation and other similar types of apertured supporting surfaces containing a series of holes which are aligned both vertically and horizontally. These supporting surfaces are normally nailed or otherwise fastened to walls with strips of wood or similar material intervening between the wall and the supporting surface so as to provide a free space.

Various types of support members such as hooks, brackets and the like, have been manufactured specially and these, for the most part, have two rearwardly projecting elements which can be inserted into the apertures. In some cases the upper rearwardly projecting element has an upwardly projecting end on the projecting portion adapted to extend upwardly after the projecting portion has been inserted into one of the apertures. This assist to some extent in retaining the support member in place. However in most cases, when an article is removed from the support member the latter is also disengaged from the supporting surfaces and very often itself is removed with the article. As a result, when the article is removed it is frequently necessary to recover and reapply the support member to the supporting surface.

An object of this invention is to provide support members which are adapted to be inserted into and secured to apertured supporting surfaces having at least three aligned equally spaced holes or apertures penetrating through said supporting ting surfaces and which will remain locked in place when an article is applied to the support member or thereafter removed therefrom.

Other objects and advantages of the invention will appear from the following description in conjunction with the accompanying drawings in which:

FIG. 20 is a side elevational view of a modified type of support member supported on a supporting surface such as apertured wall board with parts broken away;

FIG. 21 is a front elevational view of the support member shown in FIG. 20;

FIG. 22 is a plan view of the support member shown in FIG. 20 taken along the lines 22,22 of FIG. 20;

Figure 23:
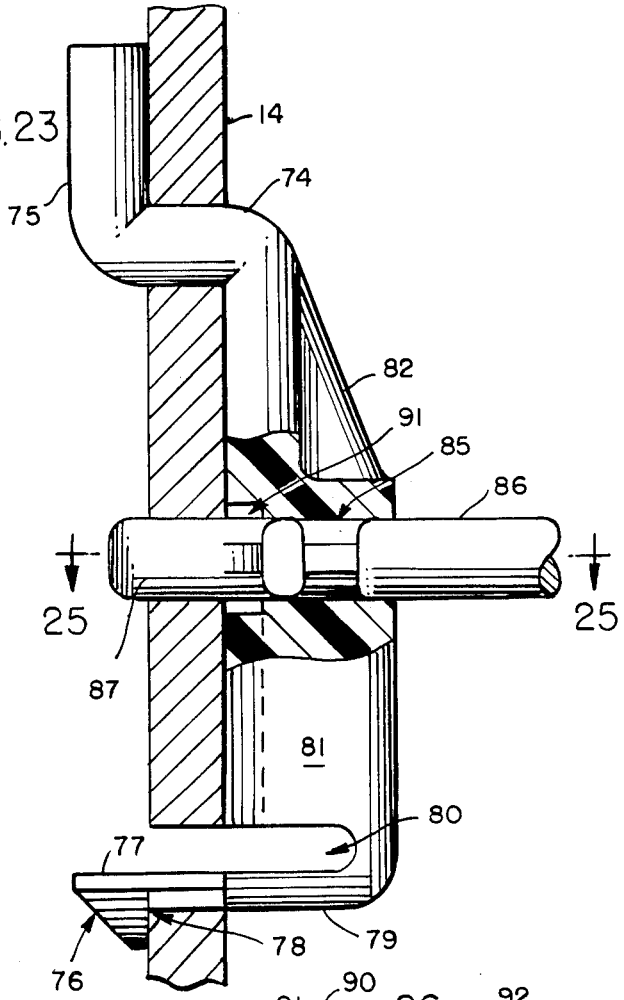
Figure 24:
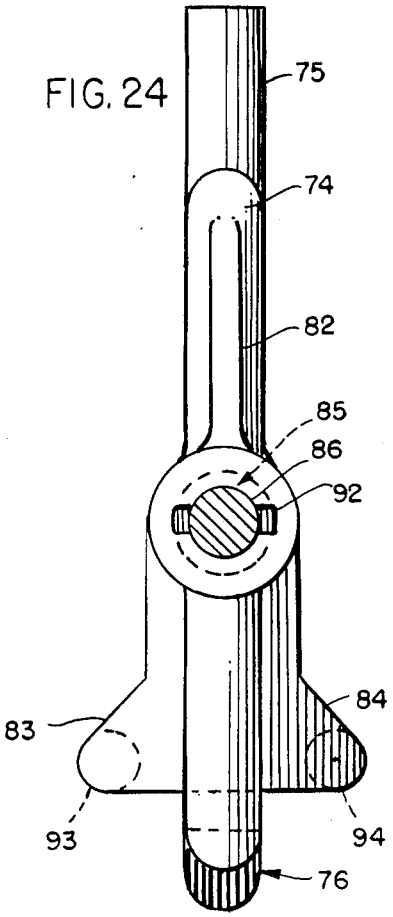
Figure 25:
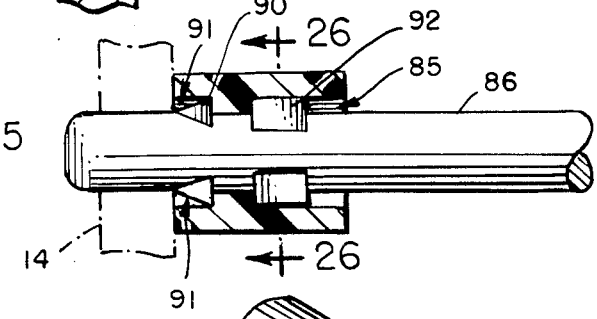
Figure 26:
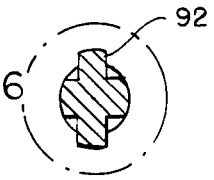
Figure 27:
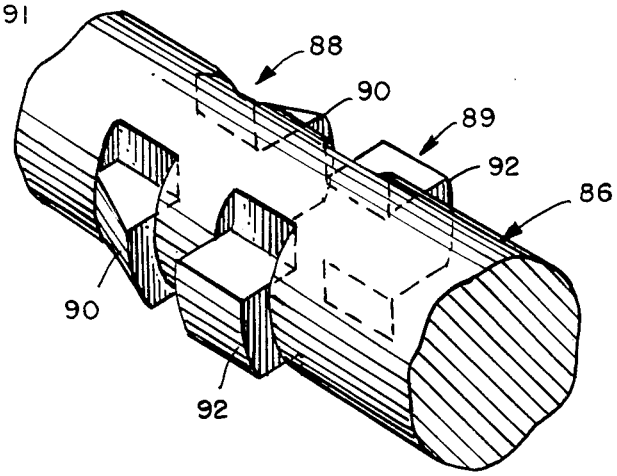

FIG. 23 is a side elevational view with parts broken away of another modified form of a support member mounted on apertured wall board illustrating a modification in which the means to support objects in the form a round rod constitutes a separate element of the support member which can be combined with the support member, either before or after the support member is in place and which can be locked into the support member after it has been combined with the support member;

FIG. 24 is a front elevational view of the support member shown in FIG. 23;

FIG. 25 is a cross sectional view taken along the line 25,25 of FIG. 23;

FIG. 26 is a cross sectional view taken along the line 26,26 of FIG. 25; and FIG. 27 is a perspective view, with parts broken away, of the rod element that is inserted into the support member of FIG. 23 showing particularly means for holding the said rod element in place.

BRIEF SUMMARY OF THE INVENTION

In accordance with the invention a support member for apertured supporting surfaces having at least three aligned equally spaced holes or apertures penetrating through said supporting surfaces is provided with means for locking said support member with respect to said supporting surfaces so that the support member will not become disengaged from the supporting surface in ordinary usage.

The invention also provides a support member of the type described which, after being locked in place in the apertured supporting surface, can be readily and easily disengaged therefrom.

Another feature of the invention is the provision of support members and shelving structures which are specially adapted to be used therewith.

A further feature of the invention is that provision of support members in which article supporting means is separable and can be shipped separately with the support member for assembly and attachment to the support member by the user or, if desired, by the supplier at the point of sale.

DETAILED DESCRIPTION OF THE INVENTION

Each of the support members shown in the drawings in general have as a front face provided with means to support objects, a rear face provided with means adapted to be inserted into and secured to apertured supporting surfaces having at least three aligned equally spaced holes or apertures penetrating through said supporting surfaces to a free space back of said supporting surfaces and insertion means comprising:

(a) an upper rearwardly projecting portion adapted to be inserted into one of said apertures in said supporting surface;

(b) a lower rearwardly projecting portion adapted to be inserted into another of said apertures in said supporting surface;

(c) a third rearwardly projecting portion adapted to be inserted into an intermediate aperture of said supporting surface, and (d) locking means associated with at least one of said projecting portions of (a), (b) or (c) to lock said support member in supporting relationship to said supporting surfaces.

In the support member generally indicated at 1 in FIGS. 1–10 which is preferably made of a molded plastic material, rod 2, which serves as a supporting means for objects, extends outwardly from the front face of an integrally molded collar 3 of support member 1 and has a slanted or upwardly extending portion 4. Collar 3 is integrally molded into the front face 4 of support member 1 and ribs 5 and 6 are also integrally molded into the front face 4 of support member 1 in order to provide enhanced strength and rigidity. The upper back side of support member 1 has a projecting portion 7 extending rearwardly with an undercut area 8. The lower portion of support member 1 has a projecting portion 9 extending rearwardly with an undercut portion 10. A resilient portion 11 is integrally molded and spaced from the back side of support member 4. Resilient portion 11 contains a projecting portion 12 and transversely extending members 13,13 or wings which are adapted to be grasped manually.

Figure 1:
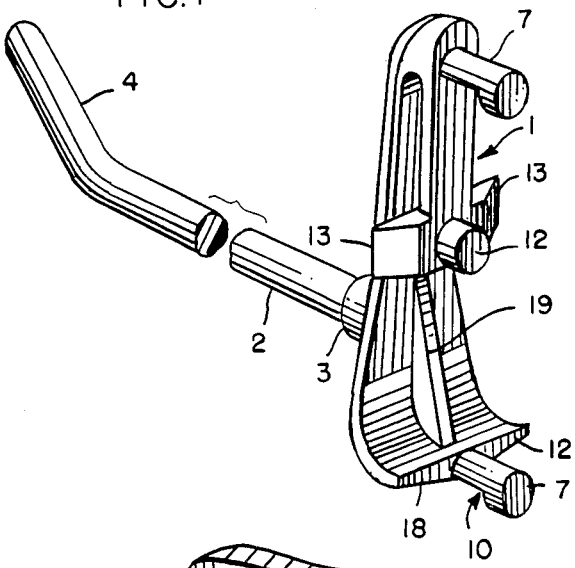
FIG. 1 is a perspective rear view of one form of support member provided in accordance with the invention.
Figure 2:
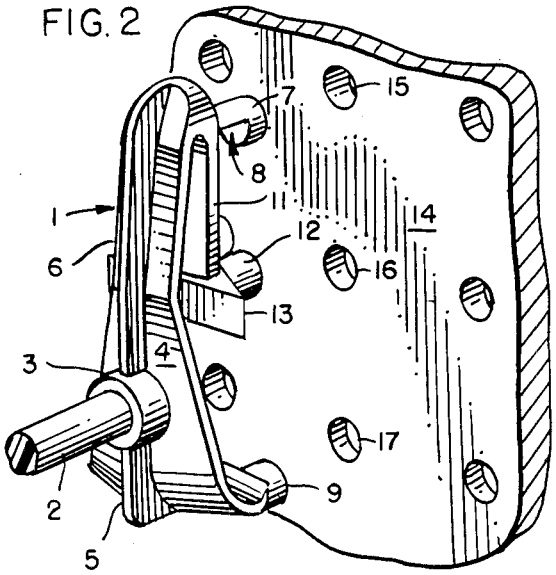
FIGS. 2, 3 and 4 are perspective views of the front of the support member shown in FIG. 1 illustrating the manner in which it is applied to an apertured wall board.
Figure 3:
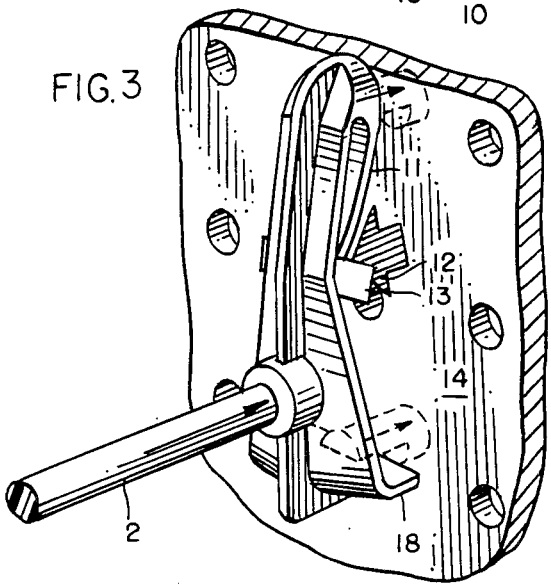
Figure 4:
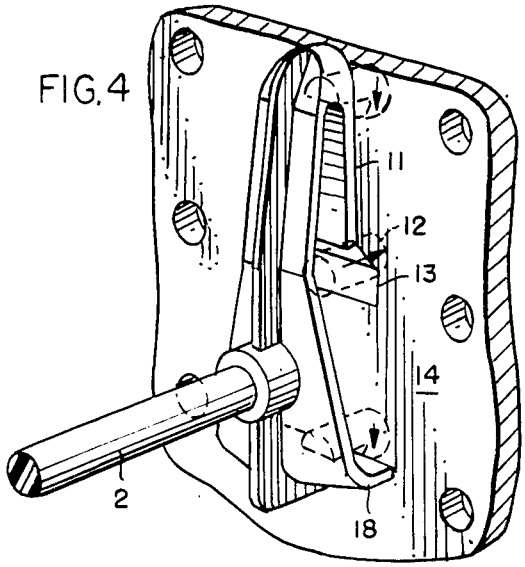
Figure 5:
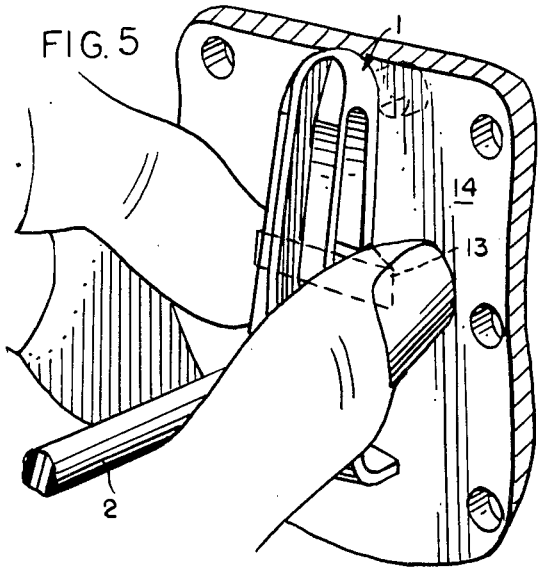
FIGS. 5 and 6 are perspective views illustrating how the support member of FIG. 1 is removed from an apertured wall board after it had previously been locked in place.
Figure 6:
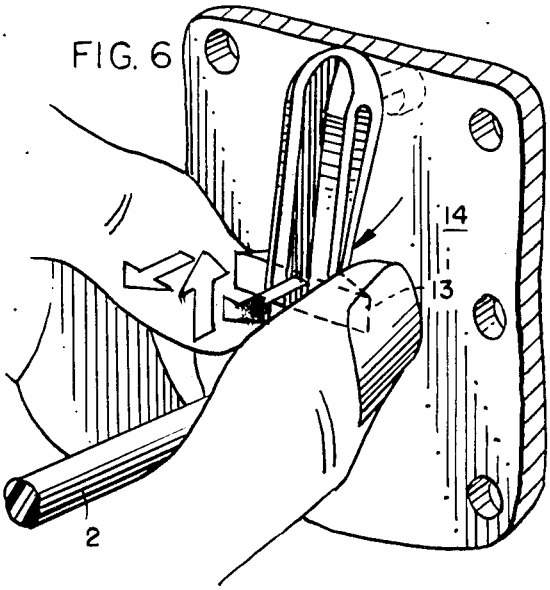
Figure 7:
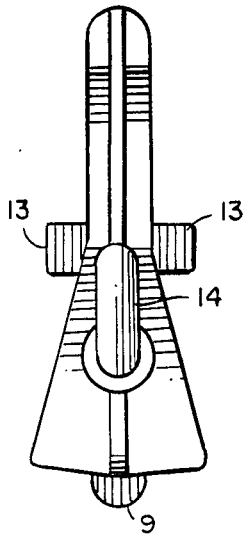
FIG. 7 is a front elevational view of the support member shown in FIG. 1.
Figure 9:
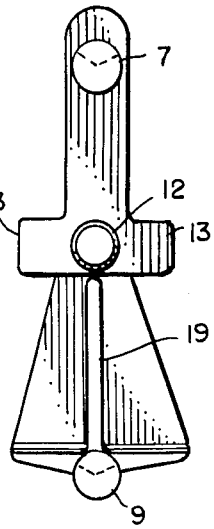
FIG. 9 is a rear elevational view of the support member shown in FIG. 1.

As shown in FIGS. 2–6, the apertured supporting surface 14 contains a series of holes which are parallel vertically and horizontally. The support member is adapted to be inserted into three aligned holes 15, 16 and 17 as shown in FIG. 2. The projecting portion 12 is actually out of line with the hole 16 when the projecting portions 7 and 9 are inserted into holes 15 and 17, respectively. This causes the projecting portion 12 to impinge temporarily against the face of apertured supporting surface 14 as shown in FIG. 3. However, when the support member is moved downwardly after projecting portions 7 and 9 have been inserted through holes 15 and 17, projecting portion 12 becomes aligned with hole 16 and snaps into place, thereby locking the support member against the front of the apertured supporting surface in the position shown in FIG. 4. The support member can be unlocked by grasping the wings 13 and pulling the projecting portion 12 out of the hole 16 while simultaneously raising projections 7 and 9 and withdrawing them through holes 15 and 17 as generally illustrated in FIGS. 5 and 6.

A further feature of the support member is the provision of flanges 18,18 which bear against the front of the apertured supporting surfaces and thereby tend to restrict any side to side movement of the support member.

A further feature of the invention is the provision of a reenforcing rib 19 which further enhances the rigidity of the support member.

The previously described structure can be molded of any of a number of well known plastic materials.

Figure 8:
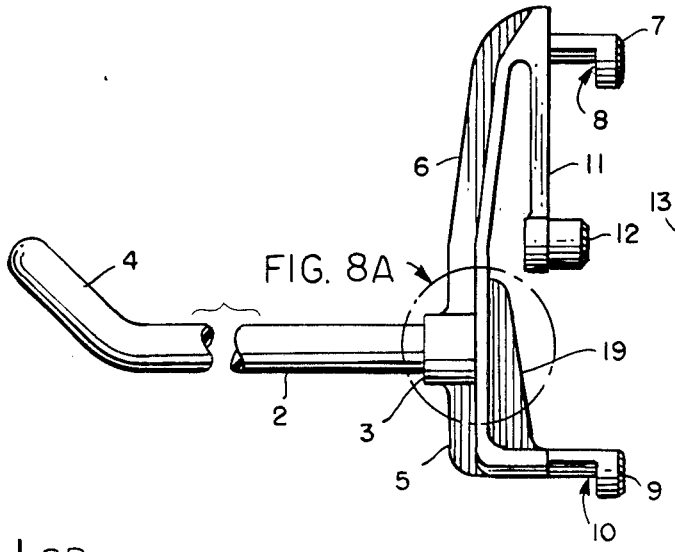
FIG. 8 is a side elevational view of the support member shown in FIG. 1.
Figure 8A:
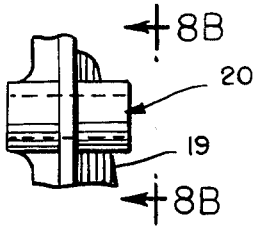
FIGS. 8A and 8B illustrate modifications of the support member shown in FIGS. 1 to 8.
Figure 8B:
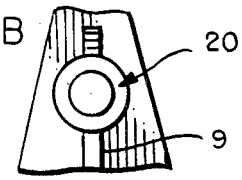

In FIGS. 8A and 8B a modification of the support member of FIGS. 1–10 is illustrated in which the encircled portion of 8A is modified so that the support member is provided with a tubular hole 20 into which the object supporting means 2 can be inserted rather than having the object supporting means integrally molded with the support member. The hole 2 can be circular, rectangular or have other polygonal configuration so as to receive an object supporting means 2 having a corresponding configuration. One advantage of this type of structure is that the support member and the article supporting means can be packaged as separate units and shipped in smaller packages. The article supporting means can also have various shapes to accommodate various uses.

Figure 10:
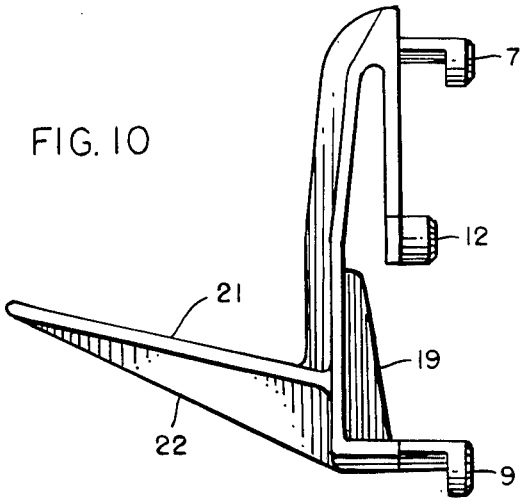
FIG. 10 is a side elevational view of another modified form of the structure shown in FIGS. 1 to 8.

FIG. 10 illustrates a modification of the invention in which the article supporting means 21 has a flat surface reenforced with a rib 22 and is adapted to hold a flat shelf.

Figure 11:
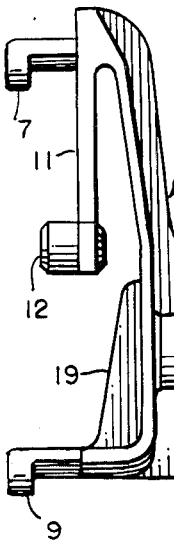
FIG. 11 is a side elevational view of the support member shown in FIGS. 1 to 8 with a shelf supporting structure.
Figure 12:
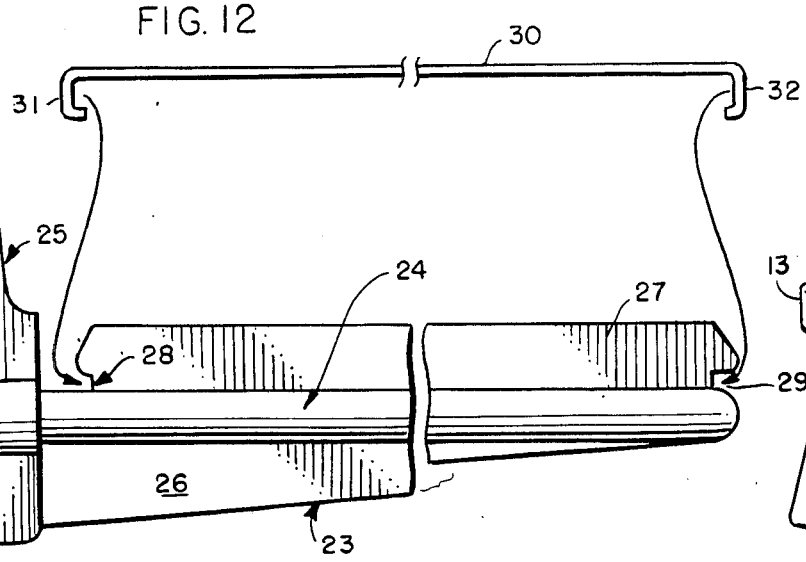
FIG. 12 illustrates the type of shelf which is adapted to be supported by the support member shown in FIG. 11.
Figure 13:
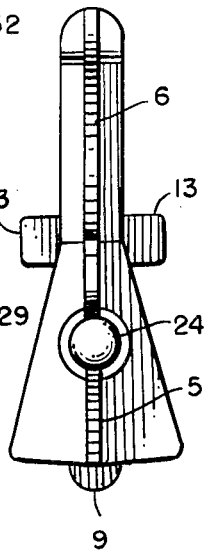
FIG. 13 is a profile or front end view of the support structure shown in FIG. 11.

FIG. 11 illustrates a modification of the invention in which the article supporting means 23 has a central member 24 connected to support member 25 with a reenforcing rib 26 and an upper shelf supporting surface 27 having undercut portions 28 and 29 adapted to receive a shelf 30 having inwardly turned ends 31 and 32 which are sufficiently flexible to snap over the ends of the supporting surface 27 into the undercut portions 28 and 29.

Figure 15:
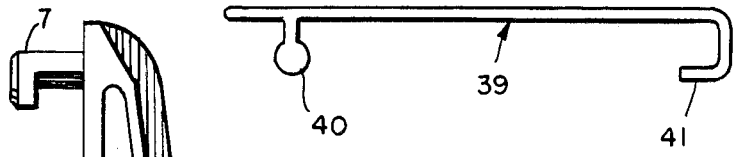
FIG. 15 is a side elevational view of a type of shelf which can be supported by the structure shown in FIG. 14.
Figure 14:
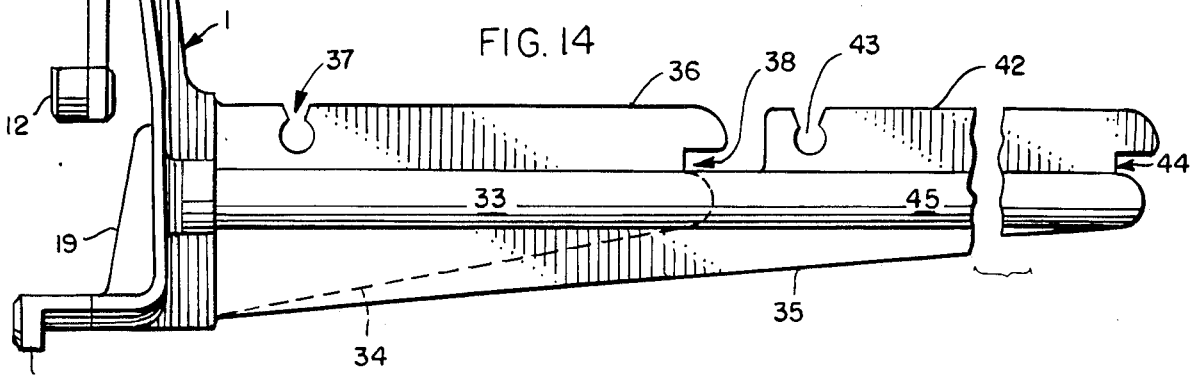
FIG. 14 is a side elevational view illustrating a modified form of shelf supporting structure with a support member of the type described in FIGS. 1 to 8.
Figure 19:
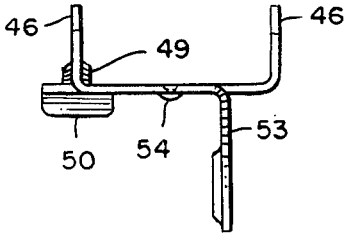
FIG. 19 is a top plan view of the structure shown in FIGS. 16 and 17 with a portion of the shelf supporting structure broken away.
Figure 18:
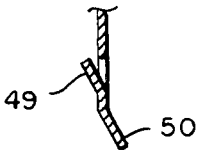
FIG. 18 is a cross sectional view taken along the line 18,18 of FIG. 17.

In FIG. 14 the central member 33 of the article supporting means is connected to support member 1 in the manner previously described and has a reenforcing rib 34 as indicated by the dotted line or a longer reenforcing rib 35, if a wider shelf is desired, and the shelf supporting means 36 is provided with a recess 37 and an undercut portion 38 adapted to receive a shelf 39 as shown in FIG. 15 having a projecting portion 40 which can be pressed into recess 37 and an inwardly turned portion 41 adapted to be received in the undercut portion 38 whereby the shelf can be snapped into place by first inserting the inwardly turned portion 41 into the undercut portion 38 and snapping the projecting portion 40 downwardly into recess 37. If a wider shelf is desired, an additional shelf receiving structure 42 having a recessed portion 43 and an undercut portion 44 can be provided by extending rod 33 with an extension 45.

Figure 17:
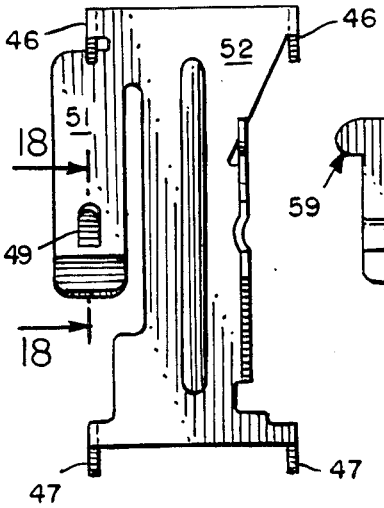
FIG. 17 is a front elevational view of the support member shown in FIG. 16.
Figure 16:
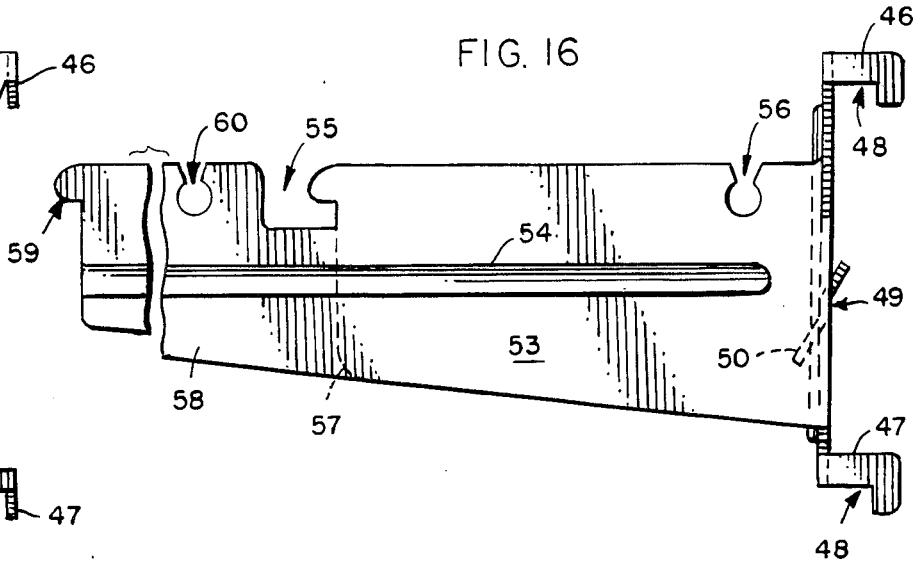
FIG. 16 is a side elevational view illustrating a support member adapted to be made from a stamping which is a modification of the type of support member shown in FIGS. 1 to 8.

In the article support member illustrated in FIGS. 16–19, the structure is especially adapted to be made in the form of a metal stamping. The support member has a plurality of upper projecting portions 46,46 and a plurality of lower projecting portions 47,47 each having an undercut portion 48. The projecting portion 46,46 are adapted to be inserted into apertures or holes in an apertured supporting surface in the same horizontal plane and the projecting portions 47,47 are adapted to fit into apertures or holes in an apertured supporting surface in a different horizontal plane, thereby stabilizing the support member with respect to side to side movement. After the projecting portions 46,46 and 47,47 have been inserted into their respective apertures and pulled downwardly so that the sides of the undercut portions 48 engage the sides of the holes, the spring metal member 49 engage an intermediate hole or aperture thereby locking the support member into place. The member 49 which is resilient, can be disengaged by pressing against the projecting end 50 to unlock the support member from the apertured supporting surface and permit its removal by lifting the support member so that the projecting portions 46 and 47 can be disengaged from their respective apertures or holes. The resilient member 49 as shown particularly in FIG. 17 is formed by stamping it out of the flat portion 51 which is integral with the main body 52 of the support member. The article supporting member 53 is formed integrally with the front face of the main body 52 of the support member and is provided with a reenforcing rib 54. The upper surface of article supporting member 53 is provided with an undercut recessed area 55 and a recessed portion 56 similar to the structure shown in FIG. 14 and is adapted to receive a shelf member similar to that shown in FIG. 15. The article supporting member 53 can terminate at the dotted line 57 as shown in FIG. 16 or it can have an extension 58 which provides an additional shelf supporting surface for an additional shelf similar to that shown in FIG. 15. In this way, the shelf shown in FIG. 15 can be applied to the article supporting member 53 by placing the inwardly turned end over the undercut portion 55 and snapping projection 40 into the recessed portion 56. If the extended shelf structure is used, the inwardly turned end 41 of the shelf in FIG. 15 is placed over the undercut end 59 and the projection 40 is snapped into the recessed portion 60.

In the modified structure shown in FIGS. 20, 21 and 22 the support member 61 is preferably molded from a plastic material with the upper projecting portion 62 adapted to be inserted into an aperture in the apertured supporting surface 14. In this structure the upwardly extending portion 63 is adapted to lie along the back side of the apertured supporting surface 14 after the upper projecting portion 62 has been inserted. This type of structure in itself is known in the art but has not heretofore been used in conjunction with the remainder of the structure of the support member in such a way that the support member can be locked into place. An intermediate projecting portion 64 is adapted to be inserted into a vertically aligned hole or aperture in apertured supporting surface 14 and a lower projecting portion general indicated at 65 is adapted to be inserted into a lower vertically aligned aperture in apertured supporting surface 14. The projecting portion 65 is shaped with an undercut area 66 and is mounted on the end of a resilient or spring-like portion 67 so that projecting portion 65 snaps into place when the support member is inserted into the apertured supporting surface and is locked in place. It can be disengaged and removed, however, by pressing upwardly on the resilient portion 67 and pulling the support member away from the apertured supporting surface. The main body 68 of the support member is provided with a reenforcing vertically extending rib 69 and transversely extending members 70 and 71 which are adapted to prevent side to side movement of the support member and serve the dual purpose of providing means for manually grasping the support member when it is removed from the apertured supporting surface. It will be recognized that the size of the projecting portion 65 must be sufficient to accommodate penetration into and removable from opening 72 in the apertured supporting surface and the free space 73 between resilient member 67 and the main body 68 of the support member must be sufficient also to permit insertion and disengagement of the projecting portion 65 from the opening 72 in the apertured supporting surface.

In the support member illustrated in FIGS. 23–27, the upper projecting portion 74 is generally similar to the upper projecting portion in FIG. 20 and it is adapted to be inserted into an opening or hole in apertured supporting surface 14 so that after insertion the vertically extending portion 75 will lie along the back of the apertured supporting surface 14 and tend to hold the support member in place at its upper end. The lower insertion member 76 is generally similar in construction to the insertion member 65 in FIG. 20 in that it has a projecting portion 77 which is adapted to be inserted into a vertically aligned opening in apertured supporting surface 14 and has an undercut portion 78 as well as resilient portion 79 permitting it to be snapped into place after it is inserted and to be disengaged by moving the resilient portion upwardly. The space 80 provides room for movement of the resilient arm 79.

The main body 81 of the support member has a reenforcing rib 82 and transversely extending sides 83 and 84 which are adapted to lie along the front of the supporting surface 14 and prevent side to side movement. They also can be grasped to assist in removal of the support member from the apertured supporting surface 14. A feature of this support member is the provision of a hole generally indicated at 85 which extends through the main body 81 from front to back and is adapted to receive article supporting member 86, the end 87 of which is adapted to be inserted into an aperture in the apertured supporting surface. This structure permits the article supporting member 86 to be packaged separately from the remainder of the support member and to be inserted either by the seller or the user at the point of sale. A further feature of the article supporting member 86 is the provision of means for holding it in place generally indicated at 88 in FIG. 27 and means for preventing it from turning generally indicated at 89 in FIG. 27. In order to assemble the article support member 86 with the main body 81 of the support member, the member 86 is simply inserted in the opening or hole 85 in the support member and the outwardly extending edges 90,90 of the holding means 88 snapped into place in space 91 provided on the inner surface of opening 85 (see FIG. 25). At the same time the projecting portions 92,92 of the means for preventing turning 89 engage slots or grooves on the inner surface of opening 85 in the main body 81 of the support member so that once the article support member 86 is inserted, it is firmly locked in place and provides not only a firm support for any articles or objects or a shelf and at the same time also, due to the fact that the projecting end 87 passes through one of the apertures in the supporting surface 14, assists in maintaining the vertical alignment of the support member. The transversely extending sides 83 and 84 are preferably provided with embossments 93 and 94 which keep them spaced from the supporting surface 14 when the support member has been inserted and thereby makes it easier to grasp the support member manually in order to permit its disengagement and removal from the supporting surface 14.

Conventional apertured supporting surfaces of the type previously mentioned normally have holes penetrating through the surfaces which are spaced both vertically and horizontally in parallel rows about one inch distance between each hole. The size of the holes in most cases are either $\frac{1}{4}$ inch or $\frac{1}{8}$ inch. The sizes of the projecting portions of the support members which are adapted to fit into these holes can be varied to fit various sizes of apertures in the apertured supporting surface. The structural materials used in making the support members can also be varied and can be either of metal or plastic. Currently most of the support members adapted to be used with apertured supporting surfaces are made of metal but the support members herein described are especially adapted to be made from plastic except for the support member described in connection with FIGS. 16–19 which is especially adapted to be made from stamped metal.

The term "plastic material" as employed herein is intended to include any one or more organic polymers of the type which can be either rigid or resilient and are well known in the art. A preferred material is glass fiber reenforced polystyrene.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

The invention is hereby claimed as follows:

1. For use with an apertured mounting board having an array of substantially identical small circular holes therein, each of the order of $\frac{1}{8}$–$\frac{1}{4}$ inch in diameter, and arranged in substantially equally spaced rows and columns, and including at least three of such holes are vertically aligned, the combination of an improved self-locking support member adapted to be automatically, but releasibly, locked onto the mounting board off the front side thereof, said support member comprising, an elongated unitary rigid body sized to span the three holes in the mounting board, and having opposed front and rear faces;

three spaced but aligned projections disposed rearwardly of and substantially normal to the rear face of the elongaged body, and adapted to be inserted axially into and through said board holes from the front side of the mounting board;

two of the projections being spaced apart a distance corresponding to the spacing between two of the board holes and being substantinally rigid relative to the elongated body and to each other;

tabs integrally formed on the two projections, spaced from the rear body face a distance corresponding approximately to the thickness of the mounting board;

said two tabs and two projections being sized, to be inserted axially into the board holes until the tabs clear the rear face of the mounting board, and then to be moved laterally to a set position, where the projections are against the board at the holes and the tabs overlap and engage the rear board face and preclude axial removal from the board holes;

an arm integral with the body near one of the two projections and cantilevered therefrom toward the other of the two projections and being elongated substantially in line with the rear body face, and the third of the three projections being formed integrally of and rigidly on the arm at the free end thereof, said arm being substantially rigid against movement in the direction along the rear body face between the two projections, having limited flexibility to allow limited movement in the direction transverse to the rear body face, being operable to hold the third projection aligned over the third of the board holes, when the two projections are in their respective two board holes and in the set position, and having its natural unflexed position such that when such third projection is aligned with the third board hole, it would urge the third projection into the third board hole;

the third projection having a circular cross section, and also being sized to just fit into its board hole, and being operable thereby to retain the two tabs and projections in the set position relative to their respective two board holes, so as to lock the support member as mounted relative to the mounting board; and means projecting forwardly of the front face of the rigid body adapted to support objects thereon relative to the mounting board.

2. An apertured mounting board support member according to the combination of claim 1, further including means on the arm for manually gripping and flexing the arm in the direction transverse to the rear face, operable to move the third projection from its board hole and thereby allow for the lateral disengagement of the tabs from the mounting board and the axial withdrawal of the projections from the board holes, for removing the support member from the mounting board; and wherein the means for manually gripping and flexing said arm includes wing means formed transversely thereon and extended generally in the direction of the rear body face.

3. An apertured mounting board support member according to the combination of claim 1, wherein each of the tabs is cylindrical and sized in diameter to just fit into and through its board hole, and wherein each of the two projections, in the region to be within the board holes, is notched away from the tab cylinder to be sized substantially less than the size of the board hole, to allow lateral movement of the two projections after being inserted into the board hole to move the tabs into overlapping relation relative to the rear face of the board to preclude axial withdrawal of the projections.

* * * * *